US008075452B2

(12) United States Patent
Isaacson et al.

(10) Patent No.: US 8,075,452 B2
(45) Date of Patent: Dec. 13, 2011

(54) COMPOSITE DIVING BOARD

(75) Inventors: William B. Isaacson, Stanley, ND (US); Chad A. Ulven, Walcott, ND (US)

(73) Assignee: Duraflex International Corp., Sparks, NV (US)

( * ) Notice: Subject to any disclaimer, the term of this patent is extended or adjusted under 35 U.S.C. 154(b) by 0 days.

(21) Appl. No.: 12/875,177

(22) Filed: Sep. 3, 2010

(65) Prior Publication Data

US 2011/0059826 A1 Mar. 10, 2011

Related U.S. Application Data

(60) Provisional application No. 61/239,812, filed on Sep. 4, 2009.

(51) Int. Cl.
*A63B 5/08* (2006.01)

(52) U.S. Cl. ..... 482/30

(58) Field of Classification Search ..... 482/30–32
See application file for complete search history.

(56) References Cited

U.S. PATENT DOCUMENTS

| | | | | | |
|---|---|---|---|---|---|
| 2,831,688 | A | * | 4/1958 | Knox | 482/30 |
| 2,965,529 | A | * | 12/1960 | Bright | 428/45 |
| 3,035,837 | A | * | 5/1962 | Austin | 482/30 |
| 3,058,743 | A | | 10/1962 | Gabrielsen et al. | |
| 3,178,333 | A | * | 4/1965 | Gabrielsen et al. | 428/77 |
| 3,408,069 | A | * | 10/1968 | Lewis | 482/30 |
| 3,415,516 | A | * | 12/1968 | Mattingly | 482/30 |
| 3,416,793 | A | * | 12/1968 | Fox | 482/30 |
| 3,502,327 | A | | 3/1970 | Meyer | |
| 3,544,104 | A | | 12/1970 | Jenks | |
| 3,641,230 | A | | 2/1972 | Jenks | |
| 3,861,674 | A | * | 1/1975 | Buck, Jr. | 482/30 |
| 4,049,263 | A | | 9/1977 | Gerritsen et al. | |
| 4,303,238 | A | | 12/1981 | Rude | |
| 5,678,809 | A | | 10/1997 | Nakagawa et al. | |
| 2005/0184432 | A1 | | 8/2005 | Mead | |
| 2005/0281999 | A1 | | 12/2005 | Hofmann et al. | |
| 2007/0123392 | A1 | | 5/2007 | Hagerty | |

FOREIGN PATENT DOCUMENTS

| | | | |
|---|---|---|---|
| CN | 1857754 | A | 11/2006 |

OTHER PUBLICATIONS

Abstract of CN1857754; Nov. 8, 2006.
International Search Report, PCT/US10/47764, dated Oct. 13, 2010, 3 pages.
Written Opinion, PCT/US10/47764, dated Oct. 13, 2010, 5 pages.

* cited by examiner

*Primary Examiner* — Fenn Mathew
(74) *Attorney, Agent, or Firm* — Senniger Powers LLP

(57) ABSTRACT

A composite diving board comprising a composite laminate of fibers in a matrix.

25 Claims, 8 Drawing Sheets

COMPOSITE DIVING BOARD

REFERENCE TO RELATED APPLICATIONS

This application claims priority to U.S. provisional application No. 61/239,812 filed 4 Sep. 2009, the entire disclosure of which is incorporated by reference.

FIELD OF THE INVENTION

The present invention generally relates to a composite diving board for competitive diving and of the type for use in a diving board assembly comprising an elongate diving board, a diving board stand to which the board is attached at its base end, and a fulcrum.

BACKGROUND OF THE INVENTION

Conventional diving boards used in diving competitions (e.g., collegiate diving, the Olympic Games) are generally aluminum alloy boards coated with a non-skid surface material. Diving boards that have long been in use in such competitions are described, for example, in U.S. Pat. No. 4,303,238.

The greater lift a diver can obtain from a board set at any given height (usually one meter or three meters), the longer the time the diver has to perform the actual maneuvers of the dive and to achieve a proper entrance into the water. So that a diver can obtain the maximum lift from a diving board, the board should respond, to the greatest extent possible, to the motions of the diver during the diver's approach and take off from the board. The tip of the board should respond immediately and as fully as possible to the final downward loading of the board at its tip end by the diver prior to take off. Immediately prior to take off is the point at which the tip of the board flexes farthest down and then rebounds upwardly to propel the diver from the board, and it is at this time that the tip of the board moves fastest, both downward and upward.

Inasmuch as only extruded aluminum alloy boards have thus far provided the performance characteristics required for highly skilled and competitive diving, it is desirable to provide alternative board designs to provide options in terms of manufacturing methods and performance characteristics.

SUMMARY OF THE INVENTION

Briefly, therefore, the present invention is directed to a composite diving board comprising a composite laminate of fibers in a matrix.

The invention is also directed to a composite diving board comprising a composite laminate of fibers in a matrix, comprising a top surface, a bottom surface, a base end, a tip end, a length along a longitudinal axis of the board from its base end to its tip end, a width transverse to the longitudinal axis, and a thickness; a central core, an upper composite laminate between the top surface and the central core, and a lower composite laminate between the bottom surface and the central core, to define a sandwich composite of the upper composite laminate, central core, and lower composite laminate; each of the upper and lower composite laminates comprising carbon fibers in a resin matrix; each of the upper and lower composite laminates having a thickness between about 0.2 and about 0.5 inch; the central core comprises a material selected from the group consisting of polyurethane foam, polyvinyl chloride foam, polyethylene foam, polystyrene foam, wood, aluminum, aramid, cardboard, and combinations thereof; and the central core has a thickness which varies along the length of the board and is between about 0.2 and about 1.25 inches.

In another aspect the invention is directed to a composite diving board comprising a composite laminate of fibers in a matrix, wherein the board has a top surface, a bottom surface, a base end, a tip end, a length along a longitudinal axis of the board from its base end to its tip end, a width transverse to the longitudinal axis, and a thickness; a central core, an upper composite laminate between the top surface and the central core, and a lower composite laminate between the bottom surface and the central core, to define a sandwich composite of the upper composite laminate, central core, and lower composite laminate; each of the upper and lower composite laminates comprising a fibrous material and the central core comprising a material different from said fibrous material.

The invention is also directed to various methods for making a composite diving board.

Other objects and features will be in part apparent and in part pointed out hereinafter.

BRIEF DESCRIPTION OF THE DRAWINGS

Corresponding reference characters indicate corresponding parts throughout the drawings.

DETAILED DESCRIPTION OF THE PREFERRED EMBODIMENTS

In accordance with the present invention, it has been discovered that composite diving boards may be prepared that are an alternative to and in some respects an improvement over conventional aluminum alloy diving boards. As detailed elsewhere herein, it is currently believed that the composite diving boards of the present invention provide improved performance over current aluminum alloy based boards. For example, diving boards of the present invention are currently believed to accelerate from the point of greatest deflection at a greater rate than conventional diving boards, which provides greater lift. Greater lift permits a diver to perform more maneuvers and/or more intricate maneuvers than typically performed using conventional aluminum alloy-based diving boards.

The composite diving boards of the present invention are prepared from readily available materials including, for example, fibrous materials such as carbon fibers and/or other fibers as discussed herein. While one embodiment consists essentially of all fiber layers constituting an overall laminate; the currently preferred embodiment also includes a central core, such as of a closed cell polyurethane foam material. Advantageously, these materials may be readily incorporated into effective methods for preparation of the composite diving boards. In addition, these materials are currently believed to contribute to improved performance. For example, suitable fibrous materials may exhibit a greater modulus of elasticity than aluminum. This means that the board is stiffer, so a thinner cross deflection will achieve deflection comparable to aluminum alloy, and it can be made even thinner to achieve even greater deflection. Stiffness, which is a measure of how much stress causes a particular strain, is of greater importance than is strength, per se.

The composite diving boards of the present invention generally comprise a high modulus fibrous material impregnated with a resin. In one embodiment, the board has a central core, an upper composite laminate, and a lower composite laminate, and these three components together constitute a sandwich composite with the central core sandwiched between the upper and lower composite laminates. Each of the upper and lower composite laminates comprises a fibrous material. The central core comprises a material different from the fibrous material of the composite laminates. Generally, the composite laminates comprise a plurality of layers of fibrous material. The upper and lower composite laminates generally comprise a fibrous material embedded in a resin matrix. The resin-fiber structure contributes to the strength and stability of the board and also improved performance (e.g., improved tip acceleration).

Figure 1:
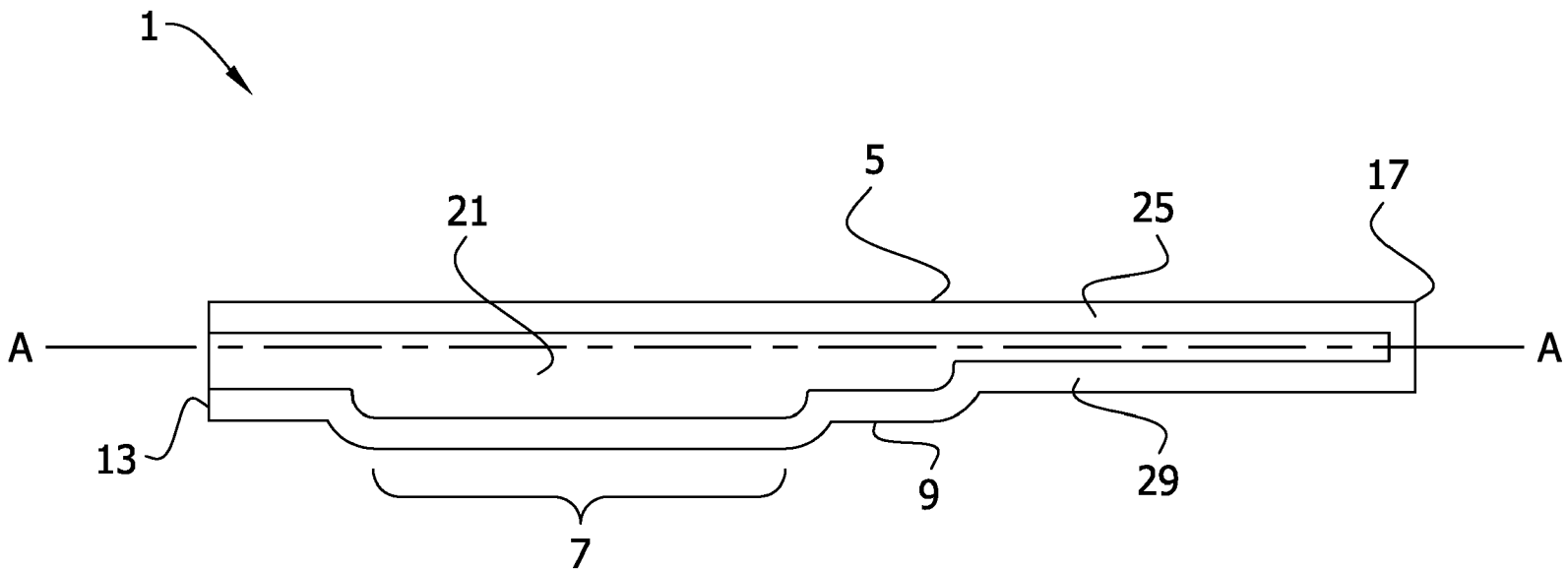
FIG. 1 is a schematic side elevation view of a diving board of the present invention in cross section.

Referring now to the drawings and FIG. 1 in particular, a diving board 1 of the present invention is shown as generally having a top surface 5, a bottom surface 9, a base end 13, and a tip end 17. The board 1 has a length along the longitudinal axis A of the board (shown by dashed lines in FIG. 1) and a width transverse the longitudinal axis. There is a fulcrum section 7 which is adapted to ride on a fulcrum of an overall diving board assembly. The fulcrum section has a generally uniform thickness from the top of the board to its bottom. The bottom of the board is tapered from the fulcrum section toward the rear or base end 13 of the board, and is again tapered from the fulcrum section toward the front or tip end 17 of the board. The fulcrum section is located between about 60 and about 90 inches from the base end. As a general proposition, the length of the fulcrum section in one embodiment is between about 4 and about 10 feet long, such as about 8 feet long. The length of the tapered section at the base end in this embodiment is between about 1 and about 4 feet long, such as about 2 feet long. And the length of the tapered section from the fulcrum section to the tip end is between about 3 and about 10 feet, such as about 6 feet long. FIG. 1 is schematic and not drawn to scale here. In this embodiment, the thickness of the board at the base end is between about 0.5 and about 2.5 inches, such as about 1.0 inch; the thickness in the fulcrum section is between about 0.75 and about 4 inches, such as about 1.5 inches; and the thickness at the tip end is between about 0.2 and about 1 inch, such as about 0.5 inches.

In the embodiment shown, there is a central core 21 sandwiched between an upper composite laminate 25 and a lower composite laminate 29, with a continuous surface of the core in continuous contact with the upper composite laminate 25 and lower composite laminate 29. The upper and lower laminates are in direct contact with the core with no other layers therebetween. For example, there are no intervening layers containing metal wires, and in fact the overall board is free of any metal wires. The central core may have an alternative configuration such as 21' in FIG. 2, or as 21" in FIG. 3.

Figure 4:
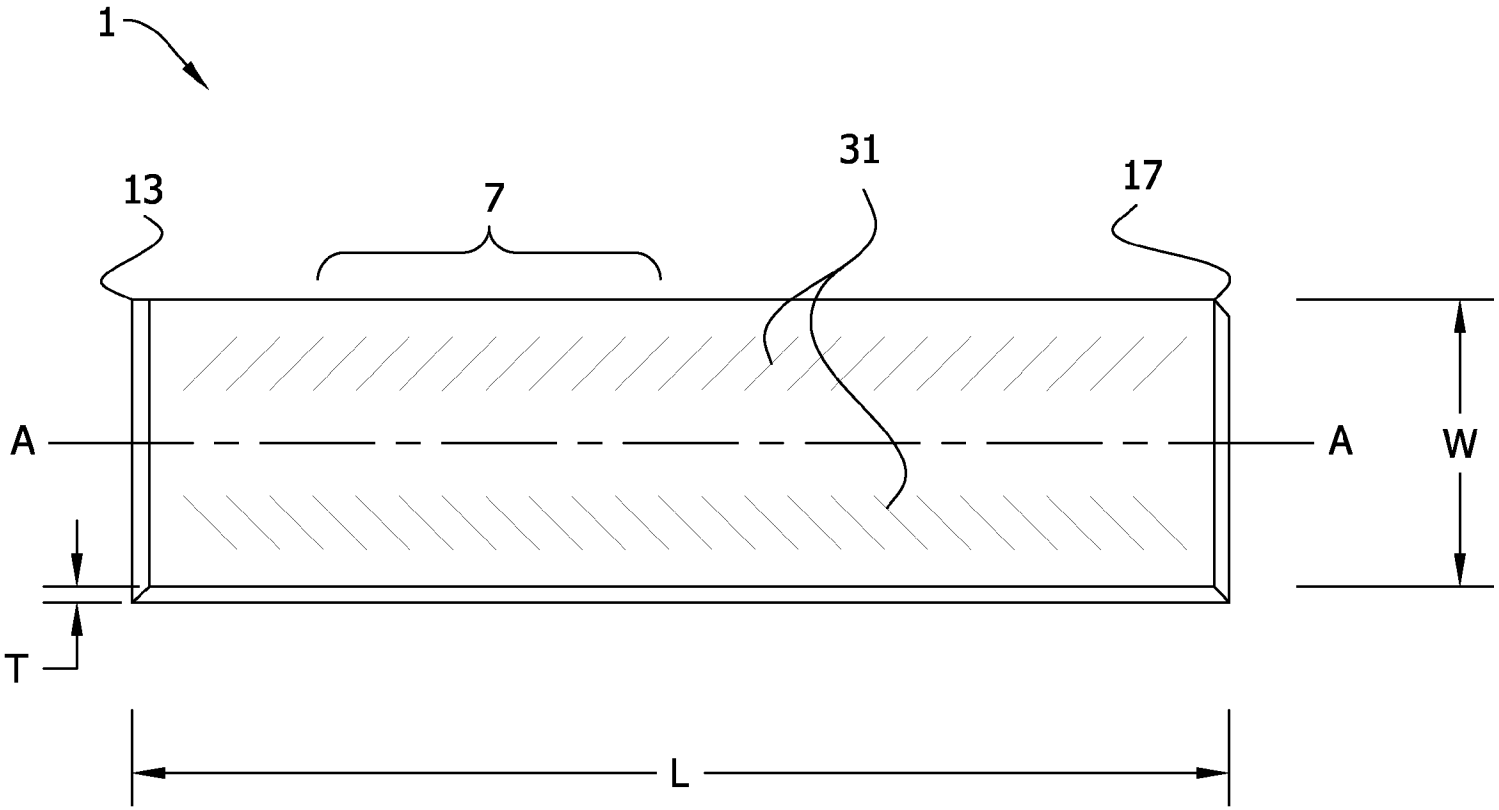
FIG. 4 is a top plan view of a diving board of the invention; with FIG. 5 being a top view in cross section.
Figure 5:
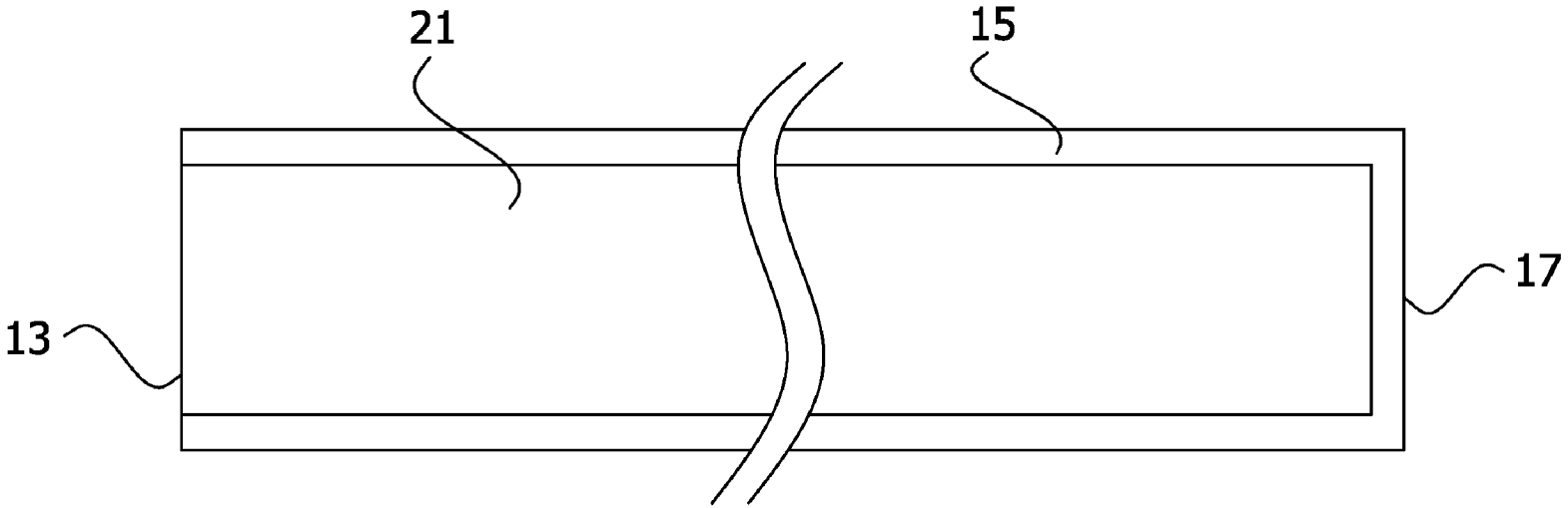

FIG. 4 is a top plan view of the board showing the length (L) of the board along its longitudinal axis (shown by dashed lines), width (W) of the board transverse the longitudinal axis, and thickness (T). FIG. 5 shows the diving board in cross section looking down on the top of the board, and depicts the core 21 terminating at the base end 13 and terminating short of the tip end 17. In a relatively small strip at the tip end 17 and along each side of the board as shown at 15 there is a section with no core 21. In this strip the upper composite laminate and lower composite laminate are in contact with each other and form one continuous laminate.

Core Material

The material of the central core (21 in FIG. 1) provides geometry, mass, and structural stability to the board, without contributing excessive weight to the board. Generally, suitable core materials in one embodiment of the invention have a density of at least about 60 kg/m$^3$, such as between about 60 and about 100 kg/m$^3$, for example about 80 kg/m$^3$. In this embodiment the core material has a compressive strength of at least about 0.8 MPa, such as between about 0.8 and 2 MPa, for example about 1.4 MPa. The compressive modulus is at least about 50 MPa, such as between about 50 and about 120 MPa, for example about 90 MPa. The shear strength is at least about 0.5 MPa, such as between about 0.5 and about 2 MPa, such as about 1.15 MPa. The shear modulus is at least about 15 MPa, such as between about 15 and 40 MPa, such as about 27 MPa.

In various embodiments, the central core comprises a foam material. For example, the core material may comprise a foam material selected from the group consisting of polyurethane, polyvinyl chloride, polyethylene, polystyrene, and combinations thereof. Suitable foam materials include both open cell and closed cell foam materials.

Closed cell foams generally exhibit a greater compressive strength than open cell foams due, at least in part, to the structure of closed cell foams in which the pores of the foam are not interconnected. In addition, closed cell foams typically exhibit a higher density than open cell foams. Each of these properties is generally advantageous in providing a structurally stable board. Closed sell foams are preferred in situations where the board is manufactured by a wet resin impregnation process such as the vacuum bag infusion option described herein, so that resin does not flow into the foam while the resin is flowing into the fiber laminate. Any substantial flow of resin into the foam could risk too great of an increase in weight. However, open cell foams are suitable in many instances, especially where the laminate composite is formed from prepregnated resin ("prepreg") fabric, and there is no risk of resin flowing into open cell foam structures.

To promote dispersion of the resin material along the surface of the core material, in one embodiment the central core includes scoring extending from a top surface of the central core toward a bottom surface of the central core in directions generally perpendicular and/or parallel to the longitudinal axis of the board. More particularly, the central core may include scoring that extends from the top surface of the central core toward the bottom surface of the central core in a dimension that is at least about 20%, at least about 35%, or at least about 50% of the thickness of the central core. This is especially preferred in wet processes such as the vacuum bag resin infusion process, as the scoring assists in dispersion of the flowable resin. Conversely, scoring would not be required where the board is made using a prepreg fabric to form the composite laminates.

Additionally or alternatively, the central core may comprise an alternative material which may be determined to provide the requisite strength. For example, the core may comprise a material selected from the group consisting of wood, cardboard, aluminum alloy, an aromatic polyamide, and combinations thereof.

Core Dimensions

The core shown in the embodiment of FIG. 1 has several distinct sections along the longitudinal axis A, including a thickest core section in the fulcrum region 7, thinner core sections on each side of the fulcrum region, and a thinnest core section toward the tip end 17. There is nothing narrowly critical about the fact that the embodiment depicted here has four such sections. This configuration of four distinct core sections is in one aspect a function of the manner in which early prototype boards have been made, that is, with a core assembled from four distinct pieces. As can be seen, the core extends to and terminates at the base end. Generally speaking, the core is of uniform thickness in the fulcrum region, and generally tapered forward and rearward of the fulcrum. The core terminates short of the tip end by between about 0.5 and about 3 inches, such as about by about 1 inch.

The central core in various preferred embodiments includes regions of varying thickness that in this embodiment provide a stepwise decrease (see core 21 in FIG. 1) or gradual decrease (see core 21' in FIGS. 2 and 21" in FIG. 3) in thickness along the longitudinal axis of the board from the fulcrum region toward the tip end of the board, and from the fulcrum region toward the base end of the board. For example, in the embodiments of FIGS. 1-3, the core has a thickness of about 0.5 inch +/−25% at the base end, 0.75 inch +/−25% in the fulcrum region, 0.5 inch +/−25% in a region forward of the fulcrum region, and 0.25 inch +/−25% in a region forward of that and toward the tip. Typically, the thickness of the central core ranges from about 0.125 to about 1.25 inch.

The core regions of varying thickness in the embodiment of FIG. 1 may be provided by a core material that includes multiple pieces of core material that have been bonded together to provide the central core. The pieces of core material may be bonded together using suitable materials including, for example, suitable epoxy resins. The pieces of core material are generally constructed of the same material, but the central core may also comprise pieces of different core materials.

Figure 3:
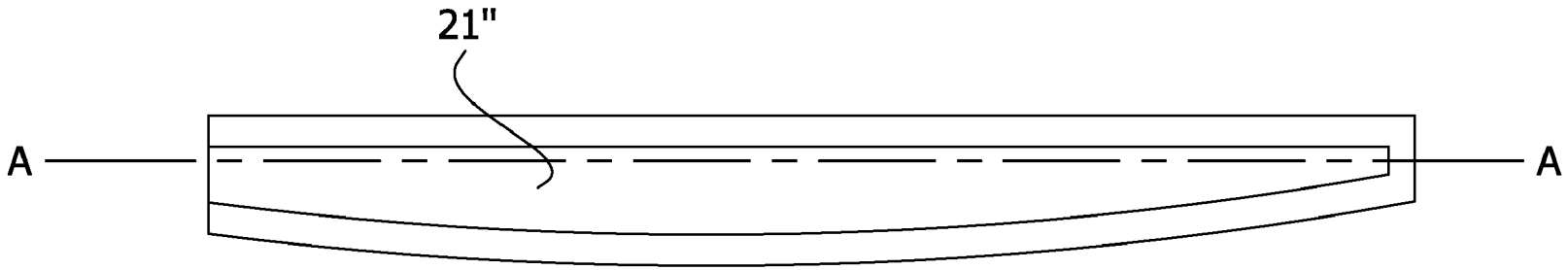
Figure 6:
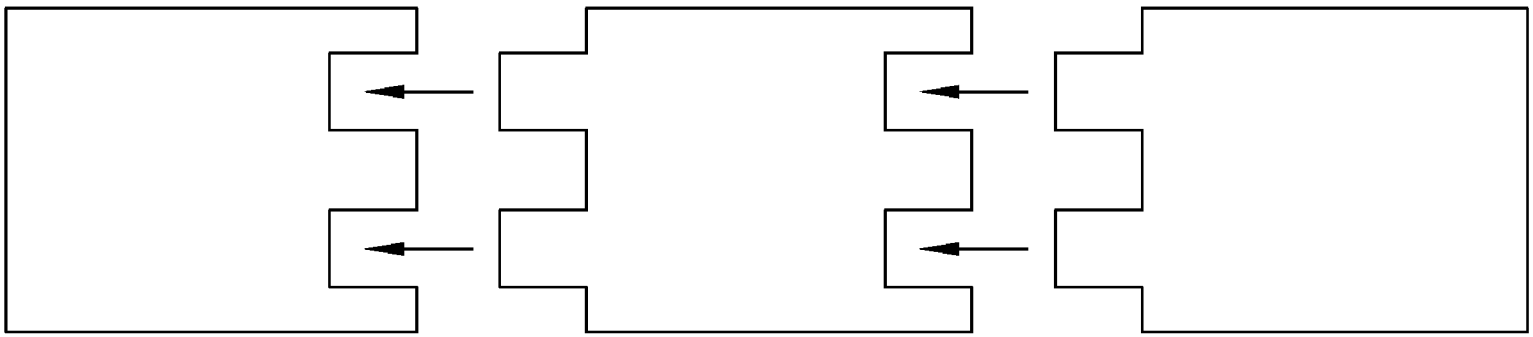
FIG. 6 is a top plan view of three distinct core components which combine to constitute a diving board core of the invention.

In an alternatively preferred embodiment, the core has a more fluid profile, with gradual reductions in thickness rearwardly and forwardly of the fulcrum section, in contrast to the more stepped configuration shown in FIG. 1. This alternative embodiment as shown in FIG. 3 has a core profile shape which is smooth and generally aspheric on the bottom. This more preferred embodiment has sections with mating components which interlockingly engage like puzzle pieces as shown in FIG. 6 to connect the various core sections and thereby form the overall core length.

Alternatively, the core may be a single piece of material, in contrast to an assembly of several distinctly manufactured pieces bonded together.

Composite Laminates

Each of the upper composite laminate 25 and lower composite laminate 29 typically comprises a plurality of layers of fiber materials in which the fibers of an individual layer are generally oriented in a single direction relative to the longitudinal axis of the board. That is, the fibers of an individual layer are generally co-aligned. The multiple layers of fibers are generally stacked upon each other without interweaving of individual layers and without interweaving of the fibers of adjacent layers. Thus, it can be said that that the fibrous material of the upper and lower composite laminates is nonwoven in this embodiment.

The fibrous material is, for example, selected from the group consisting of carbon fibers, graphite fibers, aromatic polyamide (aramid) fibers, ultra high molecular weight polyethylene fibers, ultra high molecular weight polypropylene fibers, boron fibers, and combinations thereof. The fibers are high modulus fibers in that they preferably have a modulus of, for example, more than 100 GPa. Suitable carbon fibers have a modulus typically in the range of 200-400 GPa. Suitable aramid fibers such as Kevlar brand fibers available from DuPont have a modulus on the order of 130 GPa. Suitable boron fibers have a modulus on the order of 400 GPa. Suitable ultra high molecular weight polyethylene fibers and ultra high molecular weight polypropylene fibers are orientated in that the polymer chains which constitute the polymer backbone are co-aligned with the length of the fiber. In various preferred embodiments, the fibrous material comprises carbon fibers.

Generally, each composite laminate comprises a single composite material. However, it is to be understood that suitable composite regions may be prepared that incorporate multiple fibrous materials (e.g., carbon fibers and boron fibers). Also, typically the fibrous material composition of the upper and lower composite laminates is the same. However, it is to be understood that suitable upper and lower composite laminates may also be prepared in which the respective laminates have different fibrous material compositions, different numbers of layers, different lengths, different sizes, and different combinations of orientations.

Each layer in a currently preferred embodiment contains carbon fibers in adjacent rows, with the adjacent rows having the same orientation, such as 0° with respect to the longitudinal axis of the board. These are provided in the form of a sheet or fabric of carbon fibers which are fed off of a roll, with the fabric being cut to the desired length. The adjacent fiber strands are held in place with respect to each other by a light cotton or polyethylene stitch regularly spaced along the length of the adjacent fiber strands, with the stitching running perpendicular to the fiber strands. This stitch is thereby incorporated into the final board, but after resin infusion, the stitch has no further supporting function because the fibers are held in place by cured resin.

Alternative embodiments of the invention employ individual fiber layers which may be a woven structure of fibers of one orientation interwoven with fibers of another orientation. This arrangement can be employed to incorporate more than one fiber orientation in a single textile layer, which may be advantageous especially in the higher stress region of the fulcrum. A further alternative employs fibers layers which are stitched.

Distinct from fibrous structures of the composite laminates, the board may optionally have a surface layer or surface layers of fiberglass fiber composite to impart certain properties, such as impact resistance in the fulcrum section. However, since fiberglass is not a suitable high modulus fiber for use in the upper and lower composite laminates in direct contact with the core and between which the core is sandwiched, these upper and lower composite laminates do not contain fiberglass fibers.

Generally, each of the upper and lower composite laminates comprises a plurality of fiber layers and, typically, each of the laminates comprises at least about 5, and less than about 25 layers; such as between about 10 and about 15 layers; for example 12 layers. So overall there are between about 10 and about 50 layers; such as between about 20 and 30 layers, for example 24 layers. The strip 15 in FIG. 5 where there is no core and the upper and lower composite laminates combine to form one laminate has between about 10 and about 50 layers; such as between about 20 and 30 layers, for example 24 layers.

The number of layers on the top and bottom, i.e., above the core and below the core, may be the same or may be different. That is, in certain embodiments, the upper composite laminate and the lower composite laminate do not each have the same number of layers or same thickness. Also, all individual layers do not need to be full length or width on a side. That is, the thickness of the laminates can vary across the longitudinal and/or transverse length of the board, and the laminates are not necessarily symmetrical around the core.

While the foregoing describes certain embodiments of the invention in terms of the number of layers, the invention is more precisely described in terms of overall laminate thickness, as layer thickness can vary considerably depending on various factors more germane to how the board is made and what materials are available and most economical, and not particularly germane to performance. In certain preferred embodiments, the total thickness of the laminate is on the order of between about 0.2 and about 1 inch (between about 0.1 and about 0.5 inch on each side of the core), such as between about 0.25 and about 0.75 inch, counting the thickness both above the core and below the core. In one current embodiment the total laminate is about 0.45 inch thick.

To provide a composite laminate of suitable structural stability and contribute to improved board performance, the fibrous material is embedded in a resin matrix. The resin material is, for example, selected from the group consisting of epoxy resins, vinyl ester resins, polyester resins, polyurethane resins, and combinations thereof. For example, the resin may be a two-component, low viscosity epoxy resin for use in vacuum-assisted resin transfer processes such as available from Huntsman Chemical of Texas under the trade name RenInfusion 8604 Epoxy.

In a preferred embodiment, each of the composite laminates and in fact each of the fibrous layers within the composite laminates extends fully from the base end to the tip end and fully from the left edge of the board to the right edge of the board. That is, the upper surface and lower surface of each layer is rectangular and occupies the entire rectangular surface dimension of the board.

Each composite laminate, as a general proposition, has a) a composite modulus of at least about 75 GPa, such as between about 100 and 200 GPa, for example 125 GPa; b) a composite strength of at least about 150 MPa, such as between about 175 and 400 MPa, such as about 250 MPa; and c) a strain at failure of about 1%, in accordance with ASTM D3039. The density of the composite laminates in a preferred embodiment is less than about 2.5 g/cc, such as between about 1 and about 2 g/cc.

The composite laminate has a fiber volume fraction in certain embodiments of between about 0.4 and about 0.75, such as between about 0.5 and about 0.6. Accordingly, in one embodiment the upper and lower composite laminates comprise laminate layers of carbon fibers embedded in a resin matrix, with a carbon fiber volume fraction of between about 0.4 and about 0.75, such as between about 0.5 and about 0.6, in the laminate layers.

Fiber Orientation

Figure 7:
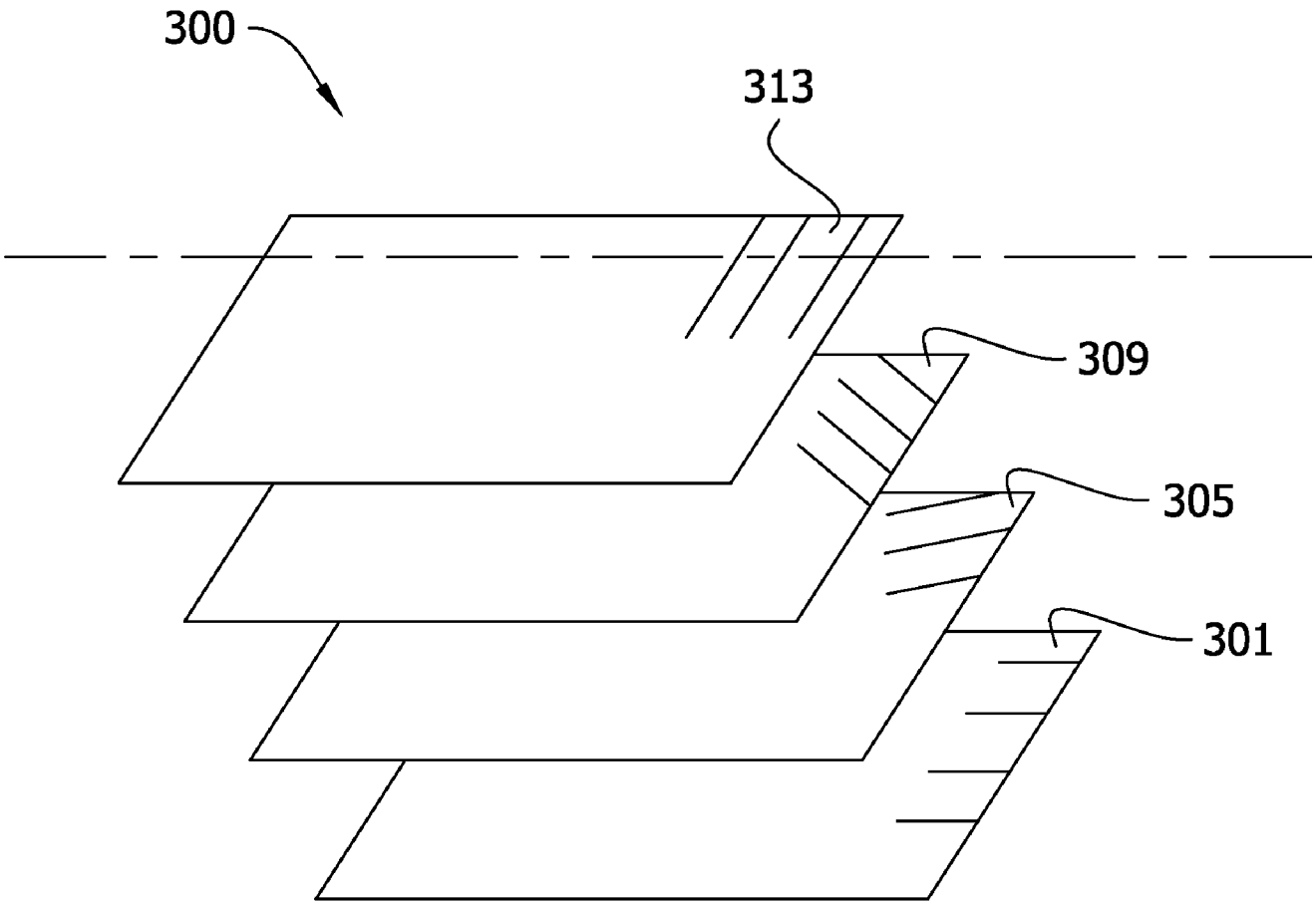
FIG. 7 is a schematic illustration of a plurality of fiber layers.

Each of the upper and lower composite laminates comprises multiple layers of fibrous material having co-aligned fibers. FIG. 7 is a schematic illustration of a collection of fiber layers 300, including fiber layers 301, 305, 309, and 313. Also shown in FIG. 7 (represented by dashed lines) is the longitudinal axis of the board.

The fibers of the fiber layers are generally oriented at an orientation angle in the range of about 0° to about 90° (+ or −) relative to the longitudinal axis of the board. So where there are, for example, 12 layers in each of the upper and lower laminates, these layers include layers of various orientations. It is preferred that each laminate has layers of at least two distinct orientations, preferably at least three distinct orientations, and in a currently preferred embodiment four distinct orientations. A preferred embodiment also includes more than one layer with fibers at 0°, at least one layer with fibers at 90°, at least one layer with fibers at an angle between about 10 and about 30°, such as 20°, and at least one layer with fibers at an angle between about −10 and about −30°, such as −20°. For example, a preferred embodiment of a composite laminate has layers of fibers oriented coaxially with the longitudinal axis of the board)(0°), one or more layers with fibers oriented at 90° with respect to the longitudinal axis, one or more layers with fibers oriented at −20°, and one or more layers with fibers oriented at +20°. As a result of the use of strategically selected varying fiber orientations, and especially of including fiber layers at an angle between about −10 and about −30°, such as −20°, it is believed that torsion is minimized so that a board assembly employing the diving board of the invention does not have to have a torsion box which was required with many aluminum alloy boards. However, it is to be understood that differing orientation of fibers of adjacent fiber layer is not required.

Often, the orientation angle varies from one fiber layer to the next according to a predetermined pattern over a thickness of the region. For example, in various preferred embodiments, the predetermined pattern comprises A degrees relative to the longitudinal axis, B degrees relative to the longitudinal axis, C degrees relative to the longitudinal axis, and D degrees relative to the longitudinal axis. In accordance with one preferred embodiment, A=0°, B=between about −10 and about −30°, such as −20°, C=between about +10 and about +30°, such as +20°, and D=90°. In one such embodiment, from the outside in, each of the two laminates has between about 5 and about 12 layers at 0°, followed by 1 to 3 layers between about −10 and about −30°, such as −20°, followed by 1 to 3 layers at 0°, followed by 1 to 3 layers between about +10 and about +30°, such as +20°, followed by 1 to 3 layers at about 90°. So one embodiment of the invention is a diving board which is a composite sandwich of a foam core between composite layers, where the composite layers each have several carbon fiber layers in 0 degree orientation and fewer layers in orientations of about 90 and about 20 degrees. For example, a currently preferred embodiment of the lower composite laminate has beginning from the bottom or outer surface and working toward the core, eight layers at 0°, followed by a layer at −20°, followed by a layer at 0°, followed by a layer at +20°, followed by a layer at 90°. This arrangement is depicted as $[0_8/-20/0/+20/90]$. In this convention, the angle is in negative degrees if it has a "−" symbol and it is in positive degrees if it has either a "+" symbol or no symbol. The orientation angles herein are all in relation to the longitudinal axis of the board unless stated otherwise. Moreover, all such angles are approximate, as of course it is not technically feasible for every fiber in a particular layer to have a precise orientation of, e.g., −20°. Each of the layers in this example is 0.018 inch thick fabric; so each of the top and the bottom laminates has a 0.216 inch thickness.

Again with reference to FIG. 7, fiber layer 301 includes fibers at an orientation angle of 0° relative to the longitudinal axis of the board (shown by dashed lines); fiber layer 305 includes fibers oriented at an angle of approximately −20° relative to the longitudinal axis; fiber layer 309 includes fibers oriented at an angle of approximately +20° relative to the longitudinal axis; and fiber layer 313 includes fibers oriented at an angle of approximately 90° relative to the longitudinal axis. In a preferred embodiment, the composite regions include several layers where the fibers are co-aligned with the longitudinal axis of the board, i.e., which have an orientation angle of about 0 degrees relative to the longitudinal axis of the board. And there are also several layers where the fibers are at an angle skewed relative to the longitudinal axis, such as at + and −20° and 90° as described above.

Board Characteristics

With reference to FIG. 4, diving board 1 is a sandwich composite which has a length, L, a width, W, and a thickness, T, and also comprises a base end 13 and a tip end 17. Diving boards of the present invention typically have a length of at least about 5 feet, or at least about 10 feet. Preferably, the length of the diving board is from about 5 to about 20 feet and, more preferably, from about 10 to about 18 feet (e.g., about 16 feet). The width of the board is typically at least about 1 foot and, more typically, from about 1 foot to about 3 feet. In most preferred embodiments where the board is for official diving competitions, the width of the board is about 20 inches.

Figure 8:
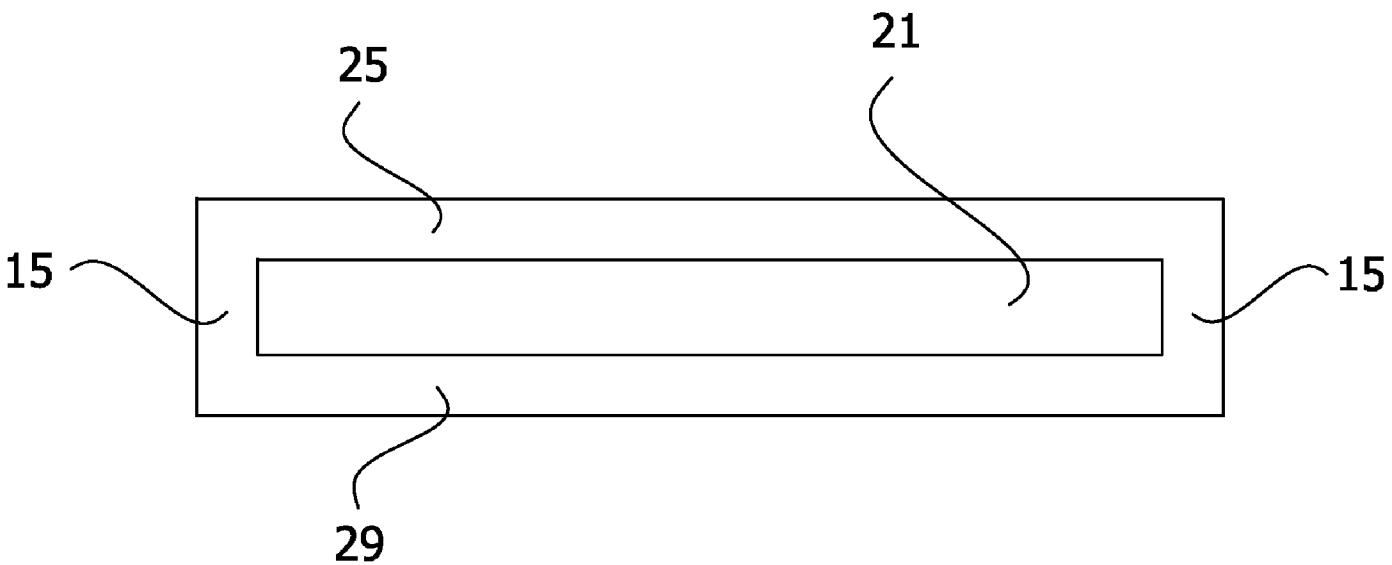
FIG. 8 is a cross-sectional view of the base end of a diving board of the invention.

As shown in FIG. 5, the width of the central core 21 shown therein is generally slightly less than the width of the board. Thus, board 1 generally comprises a region 15 around the edge of the board in which the upper and lower composite regions are in contact with no central core between them, as discussed above in connection with FIG. 5. FIG. 8 is a cross-sectional view of the base end of the board showing the central core 21 and upper composite region 25 and lower composite region 29. As is shown in FIG. 8, the lateral cross section of the core 21 in this preferred embodiment has a generally rectangular profile. And as discussed elsewhere herein, the longitudinal profile in this embodiment as shown in FIG. 1 has a stepped profile.

Typically, the edge composite region 15 extends from the edge of the board toward its center in a dimension of least about 0.5 inches, such as between about 1 and about 2.5 inches, for example about 1 inch. This structure—the edges and tip of the board comprising upper and lower laminates which combine to form a continuous laminate with no core therebetween—is believed to help reduce shear within the board and enhance the overall integrity of the board.

Generally, the thickness of the diving board is at least about 0.25 inches, or at least about 1 inch. Typically, the thickness of the diving board is from about 0.25 to about 3 inches and, more typically, from about 0.75 inch to about 2 inches. Again with reference to FIG. 1, as depicted therein the thickness of the board 1 varies along the longitudinal axis.

During use, the board 1 shown in FIG. 4 is secured on the underside of the board at its base end 13 to a diving board stand. Methods and apparatus for securing the base end of the board are well-known in the art and are described, for example, in U.S. Pat. Nos. 2,864,616 and 4,303,238, the entire contents of which are incorporated herein by reference for all relevant purposes. Again with reference to FIG. 4, the board is supported on its underside by a suitable fulcrum member (not shown) in a fulcrum section 7 of the board on which the board is adapted to pivot that is forward of the base end of the board, but between the base end of the board and the lengthwise center of the board. As shown in FIG. 3, the fulcrum section is not a precise point relative to the base end of the board but, rather, is an area along the length of the board. Fulcrum section 7 is also shown on FIG. 1. The combination of securing the board at its base end and fulcrum under the fulcrum section of the board thus supports the board in a cantilever fashion.

The diving board optionally includes a non-skid material 31 (FIG. 4) applied to the top surface of the board to provide the diver with grip during use. Suitable non-skid surface materials are generally known in the art.

The diving board also optionally includes a final spray treatment with a durable exterior polymer coating, which modifies the surface energy of the board so that water sheds from the board rather than being adsorbed onto the board.

Board Preparation

One suitable method for preparing a board of the present invention involves vacuum bagging for infusion of resin material throughout the fiber material layers. The manner of making the board is not critical, provided the method is capable of producing a composite of suitable strength and integrity. Accordingly, other suitable methods include prepreg processing followed by oven heat curing or autoclave curing under heat and pressure, or compression molding with heat.

In preparation of the board of the present invention according to the vacuum bag resin infusion method, a molding surface (typically glass) having a sufficient size for preparation of the board is selected. Onto this molding surface is sprayed a teflon emulsion, and then placed a suitable release fabric (commonly referred to as "peel ply" fabric) to facilitate eventual removal of the board from the mold after curing. On top of the peel ply layer is typically placed a porous suitable distribution media. The mesh layer promotes dispersion of the resin material laterally and lengthwise during resin infusion as detailed elsewhere herein. Then another peel-ply layer is placed on top of this distribution media.

A first layer of fibers is then laid over the aforementioned mesh layer. In the finished board, this first fiber layer will be the uppermost fibrous layer in the board. Then additional layers of fibers are laid to form a series of several distinct fiber-based layers of various orientations, as described above. Once the first series of fiber layers is in place, the core is placed on top of the fiber layers. Then a suitable distribution media strip is optionally placed around the edge of the assembly to assist in transporting the resin to the core. Then a second series of several distinct fiber layers of various orientations is laid over the core. The first and second series (or lower and upper series) of fiber layers extend beyond the edges of the core to form lengthwise and widthwise edge regions corresponding to 15 in FIG. 5 in which the lower and upper series of fiber layers are in direct contact with no core between them.

After the upper series of fiber layers is in place, an additional layer of release/peel ply fabric is placed over the board, as is an additional distribution media (e.g., Greenflow) layer to facilitate dispersion.

A permeable tube is then placed along each longitudinal edge of the board to facilitate pulling a vacuum from one side of the board to the other. A resin feed line is hooked up to one side and a vacuum line is hooked up to the other side, and vacuum bag is placed over the entire mold.

A vacuum bagging pump is arranged in fluid flow communication with the interior of the vacuum bag along a first longitudinal edge of the mold. Fluid flow communication of the pump and the interior of the vacuum bag is provided by tubing connected to the pump and placed under the vacuum bag and along the first longitudinal edge of the mold.

Along with the vacuum bagging pump, a source of resin is arranged in fluid flow communication with the interior of the vacuum bag along a second longitudinal edge of the mold. Fluid flow communication between the interior of the vacuum bag and resin source is typically provided by a source of resin equipped with a pump and suitable tubing (e.g., polyethylene tubing) placed under the vacuum bag along the second longitudinal edge of the mold.

Once fluid flow communication between interior of the vacuum bag and both the vacuum bagging pump and source of resin is established, vacuum sealing tape is placed onto the vacuum bag around the edge of the mold to secure the vacuum bag. After securely sealing the vacuum bag, a vacuum is drawn in the interior of the vacuum bag. A vacuum is drawn for a period of time such as about an hour for debulking and removing air. The resin is prepared by mixing the components, e.g., parts A and B, according to the manufacturer's instructions, prior to infusing. The viscosity of the resin in measured and compared to the manufacturer's specifications. The resin line is then opened, and drawing the vacuum further within the vacuum bag draws the resin into and throughout the fiber material arrangement along a path generally from the second longitudinal edge of the mold to the first longitudinal edge of the mold.

The vacuum is applied and resin drawn into the mold for a period until the resin layers are completely impregnated with resin as determined by visual inspection. Generally, the resin is introduced into the vacuum bag at about room temperature.

The vacuum pump and resin source are removed from fluid flow communication with the interior of the vacuum bag once resin has sufficiently spread throughout the fiber layers. The resulting resin-infused fiber material is then kept in the vacuum bag for a time sufficient to allow the resin to cool and provide a stable arrangement of resin-infused fibrous layers sandwiching the central core. This curing time is generally at least about 20 hours, such as about 24 hours and up to 48 hours.

After curing, the vacuum bag is removed from the mold, followed by removal of the second mesh and release fabric/peel ply layers. The sandwich composite of central core between upper and lower composite laminates is separated from the first mesh and release fabric layers and removed from the mold. It is then shaped to the desired dimensions by, for example, sawing, to provide a finished diving board.

The board is trimmed, holes are drilled at the attachment end, and a metal end cap is attached to facilitate mounting on a diving stand.

Additional optional layers may be applied to the board, such as a sealing material, a layer of material for protection from ultraviolet sunlight, and material that provides the board with a non-skid surface.

The board of the invention may also be made by a so-called prepreg process which employs sheets of carbon fiber pre-impregnated with resin. These types of processes are well known in the field of carbon fiber composite material manufacturing, such as in manufacturing aircraft skin components. A carbon fiber prepreg material is a combination of the fiber and epoxy resin which has been precoated and is stored cold to prevent premature curing. It is supported on a paper-backed release liner and stored in a freezer in rolls until used. The prepreg is removed from the freezer and shapes of the desired size are cut for layup. A release liner or peel ply is placed on the tool or mold (in our case a flat surface) upon which the each layer of prepreg is laid up in the desired order and orientation. After several layers have been placed on the mold, a debulking process occurs where vacuum is applied to a film cover the partially completed layup to remove entrapped air.

In the currently preferred embodiment, a core material is then laid over the prepreg layers at a predetermined location. The shape of the core has been predetermined and machined to the desired thickness and shape. Additional layers of prepreg are then placed upon the top of the core until the final layup shape is completed. There may be, for example, between about 50 and about 100 total layers, such as between about 60 and about 80 layers. One embodiment has 72 total prepreg layers. The number of layers is not narrowly critical; rather, the number of layers is selected as is necessary to achieve the desired overall laminate thickness. Debulking occurs along the way again to remove trapped air. A vacuum sealing tape is placed around the part and a film covering the part is secured to the tape. Mechanical ports are attached to the top film at several locations which will allow pulling of vacuum to compress all of the prepreg layers during the curing process.

In the case of oven cure, the part is placed in a forced air convection over where the temperature is controlled through a predetermined cycle as recommended by the manufacture. For diving boards made thus far, the cure as been for 5 hours at 180° F. There is a preheat cycle and a cool down cycle. The part is under vacuum at all times during the curing process.

In the case of the autoclave cure, the part is placed in an autoclave where vacuum is applied as in the oven curing accept additional pressure is applied via the autoclave to get a tighter packing of the carbon fibers in the prepreg material. Typical pressures can be 50-150 psi in addition to the pressure on the part caused by the vacuum bag on the part. The curing process is the same.

Typically higher fiber volume fraction and tighter fiber packing is obtained in the part by prepreg autoclave than with prepreg oven curing, and with prepreg oven curing than with vacuum assisted resin infusion.

Example 1

Figure 2:
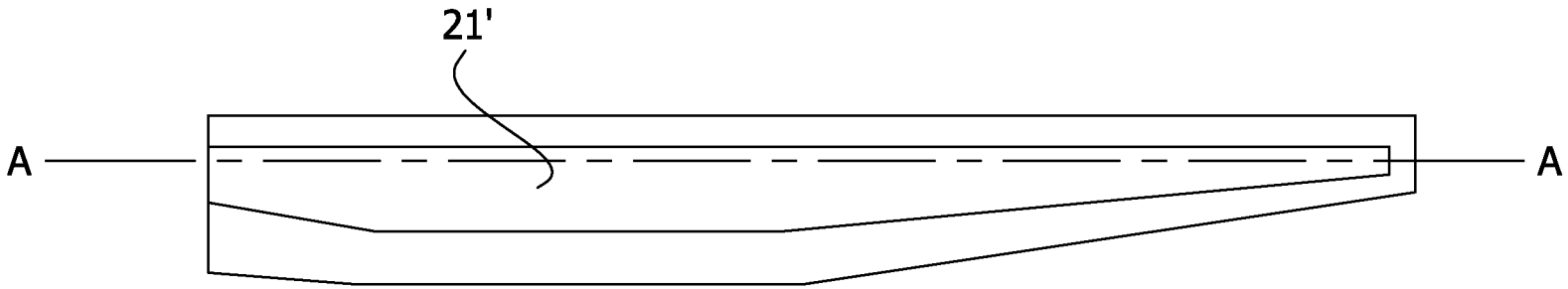
FIGS. 2 and 3 are schematic side elevation views of an alternative embodiment of the diving board of the present invention in cross section.

A diving board having dimensions of 192 inches long by 20 inches wide was prepared by the above described prepreg process with oven curing for five hours at 180° F. The shape of the foam core was generally as depicted in FIG. 2, and the core was made of closed cell foam. The thickness of the laminate on each side of the foam core was about 0.25 inches, as formed by the above-described prepreg process employing carbon fiber in resin layers. The board was mounted as it would be in service and subjected to 10,000 cycles of 1 meter deflection by a machine having an arm which pushed the board down 1 meter at its tip and then retracted, thereby allowing the board to spring back as it would in service. After 10,000 cycles, the board was inspected and there was no cracking or other notable change in the board. The board was compared to a virgin board and was shown to have less than 1/16 inch sag over the entire 192 inches of the board.

Having described the invention in detail, it will be apparent that modifications and variations are possible without departing from the scope of the invention defined in the appended claims.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained. As various changes could be made in the above products and methods without departing from the scope of the invention, it is intended that all matter contained in the above description and shown in the accompanying drawings shall be interpreted as illustrative and not in a limiting sense.

What is claimed is:

1. A composite diving board comprising:

a top surface, a bottom surface, a base end, a tip end, a length along a longitudinal axis of the board from its base end to its tip end, a width transverse to the longitudinal axis, and a thickness;

a central core, an upper composite laminate between the top surface and the central core, and a lower composite laminate between the bottom surface and the central core, to define a sandwich composite of the upper composite laminate, central core, and lower composite laminate;

each of the upper and lower composite laminates comprising a fibrous material comprising fibers having a modulus of more than 100 GPa and the central core comprising a material different from said fibrous material.

2. The diving board of claim 1 wherein the upper composite laminate and the lower composite laminate do not each have the same number of layers or same thickness.

3. The diving board of claim 1 wherein thickness of the upper and/or lower composite laminate varies within the board.

4. The diving board of claim 1 wherein the composite laminates each have a fiber architecture which is non-woven layers of unidirectional fibers.

5. The diving board of claim 1 wherein the composite laminates each have a fiber architecture which is stitched or woven.

6. The diving board of claim 1 wherein the central core comprises a material selected from the group consisting of polyurethane foam, polyvinyl chloride foam, polyethylene foam, polystyrene foam, wood, aluminum alloy, aramid, cardboard, and combinations thereof.

7. The diving board of claim 1 wherein the core is a closed cell foam material.

8. The diving board of claim 1 wherein the core is an open cell foam material.

9. The diving board of claim 1 wherein the core material is scored.

10. The diving board of claim 1 wherein the composite laminates comprise fibers in a matrix which is epoxy, vinyl ester, polyester, polyurethane, or other high strength polymeric compounds.

11. The diving board of claim 1 wherein the composite laminates comprise multiple layers of at least three distinct fiber orientations from 0° to 90° (+ or −).

12. The diving board of claim 1 wherein the composite laminates comprise multiple layers of at least three distinct fiber orientations from 0° to 90° (+ or −), with a majority of layers comprising fibers having a fiber orientation of 0° relative to the longitudinal axis of the board.

13. The diving board of claim 1 wherein the central core comprises a foam material which has a density of at least about 60 kg/m$^3$, a compressive strength of at least about 0.8 MPa, a compressive modulus of at least about 50 MPa, a shear strength of at least about 0.5 MPa, and a shear modulus of at least about 15 MPa.

14. The diving board of claim 1 wherein the central core consists of a foam material which has a density of at least about 60 kg/m$^3$, a compressive strength of at least about 0.8 MPa, a compressive modulus of at least about 50 MPa, a shear strength of at least about 0.5 MPa, and a shear modulus of at least about 15 MPa.

15. The diving board of claim 1 wherein the central core comprises a foam material which has density between about 60 and about 100 kg/m$^3$, a compressive strength between about 0.8 and 2 MPa, a compressive modulus between about 50 and about 120 MPa, a shear strength between about 0.5 and about 2 MPa, and a shear modulus between about 15 and 40 MPa.

16. The diving board of claim 1 wherein the central core consists of a foam material which has density between about 60 and about 100 kg/m$^3$, a compressive strength between about 0.8 and 2 MPa, a compressive modulus between about 50 and about 120 MPa, a shear strength between about 0.5 and about 2 MPa, and a shear modulus between about 15 and 40 MPa.

17. The diving board of claim 1 having a length of at least about 10 feet.

18. The diving board of claim 1 having a length from about 10 to about 18 feet.

19. A composite diving board comprising:

a top surface, a bottom surface, a base end, a tip end, a length along a longitudinal axis of the board from its base end to its tip end, a width transverse to the longitudinal axis, and a thickness;

a central core, an upper composite laminate between the top surface and the central core, and a lower composite laminate between the bottom surface and the central core, to define a sandwich composite of the upper composite laminate, central core, and lower composite laminate;

each of the upper and lower composite laminates comprising a fibrous material comprising fibers having a modulus of more than 100 GPa and the central core comprising a material different from said fibrous material;

wherein the fibrous material comprises high modulus fibers selected from the group consisting of carbon, graphite, aramid, orientated high molecular weight polyethylene, orientated high molecular weight polypropylene, boron, and combinations thereof.

20. The diving board of claim 19 wherein the upper and lower composite laminates comprise laminate layers of carbon fibers embedded in a resin matrix.

21. The diving board of claim 19 wherein the upper and lower composite laminates comprise laminate layers of carbon fibers embedded in a resin matrix, with a carbon fiber volume fraction of between about 0.4 and about 0.75 in the laminate layers.

22. The diving board of claim 19 wherein the upper and lower composite laminates comprise laminate layers of carbon fibers embedded in a resin matrix, with a carbon fiber volume fraction of between about 0.5 and about 0.6 in the laminate layers.

23. The diving board of claim 19 wherein:

each of the upper and lower composite laminates comprising carbon fibers in a resin matrix;

each of the upper and lower composite laminates having a thickness between about 0.2 and about 0.5 inch;

the central core comprises a material selected from the group consisting of polyurethane foam, polyvinyl chloride foam, polyethylene foam, polystyrene foam, wood, aluminum, aramid, cardboard, and combinations thereof; and the central core has a thickness which varies along the length of the board and is between about 0.2 and about 1.25 inches.

24. The diving board of claim 19 wherein the central core consists of a foam material with a continuous surface of the core in continuous contact with the upper composite laminate and lower composite laminate and the upper and lower laminates are in direct contact with the core with no other layers therebetween.

25. A composite diving board comprising a composite laminate of fibers in a matrix, comprising:

a top surface, a bottom surface, a base end, a tip end, a length along a longitudinal axis of the board from its base end to its tip end, a width transverse to the longitudinal axis, and a thickness;

a central core, an upper composite laminate between the top surface and the central core, and a lower composite laminate between the bottom surface and the central core, to define a sandwich composite of the upper composite laminate, central core, and lower composite laminate;

each of the upper and lower composite laminates comprising carbon fibers in a resin matrix;

each of the upper and lower composite laminates having a thickness between about 0.2 and about 0.5 inch;

the central core comprises a material selected from the group consisting of polyurethane foam, polyvinyl chloride foam, polyethylene foam, polystyrene foam, wood, aluminum, aramid, cardboard, and combinations thereof; and the central core has a thickness which varies along the length of the board and is between about 0.2 and about 1.25 inches.

* * * * *